US006060669A

United States Patent [19]

Dohnal et al.

[11] Patent Number: 6,060,669

[45] Date of Patent: May 9, 2000

[54] TAP SELECTOR

[75] Inventors: Dieter Dohnal, Lappersdorf; Klaus Höpfl, Maxhütte-Haidhof; Silke Wrede, Zeitlarn, all of Germany

[73] Assignee: Maschinenfabrik Reinhausen GmbH, Regensburg, Germany

[21] Appl. No.: 09/165,494

[22] Filed: Oct. 2, 1998

[30] Foreign Application Priority Data

Oct. 4, 1997 [DE] Germany ..... 197 43 864

[51] Int. Cl.[7] ..... H01H 19/58

[52] U.S. Cl. ..... 200/11 TC

[58] Field of Search ..... 200/17 R, 18; 323/340

[56] References Cited

U.S. PATENT DOCUMENTS

| | | | |
|---|---|---|---|
| 1,985,927 | 1/1935 | Jansen | 171/119 |
| 2,004,792 | 6/1935 | McCarty | 171/119 |
| 2,785,242 | 3/1957 | White | 200/18 |
| 3,066,208 | 11/1962 | Fannon, Jr. et al. | 200/153 |
| 3,155,782 | 11/1964 | Wilson, Jr. | 200/11 |
| 3,396,248 | 8/1968 | Wilson, Jr. | 200/11 |
| 5,056,377 | 10/1991 | Yatchum et al. | 74/436 |
| 5,107,200 | 4/1992 | Dohnal . | |
| 5,165,295 | 11/1992 | Dohnal et al. | 74/436 |
| 5,191,179 | 3/1993 | Yatchum et al. | 200/11 TC |
| 5,266,759 | 11/1993 | Dohnal . | |

OTHER PUBLICATIONS

"Load Tap Changer Type RMV II", Reinhausen Manufacturing, Humbolt, Tennessee, USA, No. RM 05/91–1094/5000.

*Primary Examiner*—Michael L. Gellner
*Assistant Examiner*—Nhung Nguyen
*Attorney, Agent, or Firm*—Herbert Dubno

[57] ABSTRACT

A multiphase reactor-switching tap selector has a single geneva mechanism operating three shafts which traverse phase plates carrying all of the contacts and the vacuum switching cell and rapid release mechanism for each of the phases. The geneva mechanism operates the tap selection contacts directly through its shaft and is coupled to other shafts for operating the preseslector contacts, the bypass contacts and the vacuum switching cells. All three shafts traverse all of the phase plates.

8 Claims, 8 Drawing Sheets

TAP SELECTOR

FIELD OF THE INVENTION

Our present invention relates to a tap selector operating in accordance with the reactor switching principle and utilizing interruption-free switching under load via a vacuum switching cell.

BACKGROUND OF THE INVENTION

Tap changers are used in combination with power transformers for an interruption-free switchover between successive winding taps of this transformer, primarily for interruption-free voltage control.

Tap changers for this purpose in the past have generally operated in accordance with two principles primarily in different regions of the world:

1. The slow-switching reactor switch which is currently used in the United States and was used in part in the prior Soviet Union. In this case, switching impedances are provided which, during the slow switchover from one winding tap to the next, prevent short-circuiting of the stages of the transformer and must be dimensioned for the period in which they are under load.

2. Rapidly-acting switches which have been given the name of their inventor, namely, "Jansen switches" which are used in the remainder of the world. The switchover from one winding type to the next is effected rapidly, i.e. in a jump, and utilizes switching resistances which reduce or prevent a short circuit even for the very brief time interval that the switching requires.

This application refers to tap selector switching in accordance with the first-mentioned reactor switching principle.

A tap selector of this type is described in the brochure "Load Tap Changer Type RMV II" of the firm Reinhausen Manufacturing, Humbolt, Tenn., U.S.A., No. RM 05/91-1094/5000.

In this tap selector, vacuum switching cells are provided for switching under load. Vacuum switching cells have a number of advantages by comparison with mechanical load switching contacts, namely, a significantly higher operating life. Using such vacuum switching cells a contamination of the surrounding oil is completely prevented, such contamination readily arising with mechanical switch contacts which must operate under load and therefore tend to spark or suffer significant contact burn off.

In the specific description below, reference will be made to the sequence in which the vacuum switching cell and other switch contacts of the reactor type tap selector operate and for the present purposes it is only required to understand that generally speaking the tap selector switching can be subdivided into a stage A which can be referred to as the existing stage or previous stage and a neighboring stage B which can be referred to as the subsequent stage or the stage into which the tap selector is to be switched. While the switching will be described in a single phase, it will be understood that the transformers involved are generally three-phase transformers and a set of selector contacts is normally provided for each of the phases of the three phases and the three phases are switched together, i.e. the moving switch contacts are ganged for joint movement.

It is convenient to refer to the tap which has been previously selected as the tap n and the tap to be selected as the neighboring tap is n+1 for the tapped winding of the particular phase of the transformer.

A pair of selector contacts P1 and P2 can then be provided and in succession, will both engage the previously selected tap and be moved so that a leading one of these contacts engages the next tap. In a subsequent stage the trailing contact moves over to that next tap.

In series with the contacts P1 and P2, namely, the movable selector contact, are switching impedances which can be referred to as R1 and R2, the opposite ends of these impedances being bridged by a vacuum switching cell V and having a bypass switching B with movable contacts connecting the impedance ends to a leading line L.

In a stationary state of the system prior to a tap change operation, both movable contacts P1 and P2 engage the fixed tap contacts n, the vacuum switching cell is closed while the movable contacts of the bypass switch B are closed in preparation for the next phase. In the next phase one of the movable bypass contacts opens so that the load current flow is through the vacuum switching cell and the contact of the bypass switch will remain closed. The vacuum switching cell can then be opened, cutting off the impedance associated with the open bypass contact and hence that movable selector contact can be shifted into engagement with the next tap fixed contact. The vacuum switching cell is then closed to put the new tap under load, the previously opened bypass contact is closed and the process can be repeated with opening of the vacuum switching cell and the other bypass contact until the second movable contact has made the transition from the fixed previous tap contact to the next contact.

The tap selector, as noted, is usually a three-phase system and can operate with an oil-filled housing which has the selector contacts, preselector contacts, the vacuum switching cells and the bypass contacts. The term "preselector contacts" are contacts which can be used optionally for a coarse selection (range selection) or for a possible reversal. The two switching variants are also known in connection with reaction type systems of the kind with which the invention is concerned in the art. In separate housing parts a drive is usually provided for actuating the individual contact and the vacuum switching cells.

In the housing, terminal plates are provided which are separate for each of the three phases to be switched and on which the selector and reversing contacts are provided. Further plates also provided for each phase carrying the corresponding vacuum switching cells and the associated bypass contacts. For example, on one side of such a further plate which is turned toward the corresponding terminal plate, the fixed and movable bypass contacts are provided while on the opposite side the vacuum switching cell with a respective force-storing mechanism for its actuation can be mounted.

Such a force-storing mechanism is described in detail in German patent document 41 26 824.

All of the switch elements of all of the phases can be driven by a single insulated shaft which traverses the lateral housing portions or is connected to a drive mechanism laterally of the housing. It is common in this kind of construction to provide three geneva mechanisms, one for each phase, each of which is mounted on the respective terminal plate. These geneva mechanisms convert the rotary movement of the drive shaft to the intermittent movements required to actuate the selector and reversing contacts as well as the movements for actuating the bypass contacts and for actuating the force storers to trip the corresponding vacuum switching cells in the predetermined switching sequence.

The single insulating shaft thus operates three separate geneva mechanisms and each of these geneva mechanisms actuates the movable elements of a respective terminal plate of the respective phase, namely, the tap selection contacts and via a separate pin on the Geneva mechanism, the reversing contact. Separately for each phase, utilizing a double-sided groove in the rotatable disk, the bypass contacts and the force-storing device for the vacuum-switching cell are actuated. A double-sided cam arrangement of this type is described in German patent document 40 11 019.

In practice it is found that such constructions are relatively complex and subjected to mechanical deterioration or are mechanically unreliable because of jamming or the like. The several geneva mechanisms increase the complexity and since a number of mechanisms are provided which must be cooperated with great precision, the overall fabrication cost of the apparatus is substantial. The double-sided cam for the simultaneous actuation of the bypass contacts and the vacuum-switching cells also contribute to the increased complexity and the problem is rendered more acute because the cam contours are not identical and thus even the fabrication cost for the cam is substantial.

OBJECTS OF THE INVENTION

It is therefore, the principal object of the present invention to provide a tap selector of the type described in which the construction is greatly simplified and the number of parts is significantly reduced.

Another object of the invention is to provide a tap selector utilizing a geneva mechanism, wherein, especially the number of parts forming the geneva systems is reduced.

It is also an object of this invention to provide a tap selector which is mechanically more reliable, less expensive and free from the drawbacks of earlier designs.

It is a special object of this invention to simplify the actuation of the bypass contacts and the vacuum-switching cells of a polyphase tap selector for a power transformer, thereby increasing the reliability of the tap selector in conjunction with a reduction in the complexity thereof.

SUMMARY OF THE INVENTION

These objects and others which will become apparent hereinafter are attained, in accordance with the present invention in a system wherein for each phase separately, all of the fixed contacts and all of the movable contacts and the vacuum switching cell of this phase are provided together on a respective phase plate. According to the invention, three insulating shafts extend through the housing and pass through the three phase plates, the first insulating shaft actuating all of the movable selector contacts, the second insulating shaft actuating all of the movable preselector contacts and the third insulating shaft actuating all of the movable bypass contacts and all of the vacuum switching cells. The drive mechanism has a single geneva wheel which is driven by the drive shaft of a geneva driver and which is connected with the first insulating shaft such that by each tap switching, the first insulating shaft is displaced through an angle representing one tap step, the drive mechanism having a first actuating means which operates upon the second insulating shaft and the actuating mechanism having a second actuating means which operates upon the third insulating shaft. The reference to "insulating" shafts is intended to mean that the shafts maintain the phase plates electrically isolated from one another.

Advantageously, the first actuating means comprises a roller which engages the geneva wheel and operates a corresponding lever so that at a certain position of the geneva wheel, this roller will engage in a cut-out of the lever and angularly displace the second insulating shaft by a predetermined angular displacement in a selected rotational sense.

The second actuating means can be comprised of a further drive wheel and lever mechanism operatively connected thereto and in turn acting upon the third insulating shaft so that with each rotation of the geneva wheel, the third insulating shaft is oscillated through a predetermined angle and then again returned to its starting position.

The fixed and movable bypass contacts are mounted on one side of each phase plate and the respective vacuum-switching cell on the opposite side. Advantageously, for each phase two movable selector contacts are provided which are electrically insulated from one another on a contact carrier and are moved by angular displacement thereof in common. For each phase, moreover, two movable bypass contacts are provided and are electrically connected to one another and are provided on a further contact carrier so that they can be displaced by rotation of the latter.

The force-storing device for actuating the respective vacuum-switching cell can be comprised of a control cam with a cam curve operatively connected with the third insulating shaft and rotatable therewith. A double-arm lever is provided and carries on a free end thereof a roller which rides upon the cam and in the stationary state is arrested by a pawl. On the other free end of the lever an actuating plunger or rod of the vacuum switching cell bears. The cam on its rear side has a release contour which cooperates with the pawl so that in a certain position of the third insulating shaft the pawl is actuated by the cam and triggers the vacuum switching cell so that it jumps into its open position.

The vacuum switching cell, the cam with the cam curve and its rear release contour, the double-arm lever with the roller and the springs which ensure that the roll will ride on the cam on the one hand and that the pawl will be positively engaged by the release contour, for each phase are provided on a common bracket and each bracket is attached to the respective phase plate. The release contour can be formed by two cams.

According to another feature of the invention, the single geneva wheel cooperates with a mechanical limiter establishing an end position and comprised of a blocking disk which is arranged on the first insulating shaft in the region of the geneva wheel but free to rotate independently thereof. The blocking disk has a respective entrainer on each side, one of the entrainers corresponding to a fixed abutment on the housing and the other entrainer corresponding to a further entrainer on the geneva wheel such that the geneva wheel can carry out two rotations in either direction or rotational sense. The two entrainers can be formed by a single cylindrical pin passing through the blocking disk. On the geneva wheel along the same circular segment, two entrainers are provided which limit the maximum possible angular displacement of the geneva wheel.

It is especially advantageous with the system of the present invention that only a single transmission, i.e. a single geneva mechanism, is required. All of the requisite movements for actuating the selector contacts, preselector contacts and bypass contacts and for triggering the vacuum-switching cells of all of the phases of the multiphase system are thus generated by a single geneva mechanism and transmitted by separate insulating shafts to the corresponding movable or actuatable elements. The consequence is a significant simplification.

It is another advantage of the invention that all of the switching elements for a given phase of the multiphase system can be provided on a single plate, namely, a phase plate, the opposite sides of which are utilized to carry the contacts and/or vacuum-switching cell and its actuating mechanism. It is especially advantageous that the phase plates can be of identical construction and can carry identical equipment.

Still another advantage of the system of the invention is its ability to make use of a simply constructed force-storing mechanism for actuating the respective vacuum-switching cells. The vacuum-switching cells are rapidly opened by the stored force and are closed with the force-storing device being loaded under cam control.

Finally we can mention a simplified mechanical limiting system or end stop arrangement which can be built into the single geneva mechanism and which prevents a shifting of the selector contacts beyond the permissible shifting range. The limiting elements can be provided directly on the respective phase plate. A multiphase reactor-switching tap selector for interruption-free tap shifting under load can comprise:

a housing;

a respective phase plate for each phase of the tap selector disposed in the housing, the phase plates being mutually parallel and spaced apart in the housing;

respective fixed selector contacts on the phase plate connected to respective transformer taps of the respective phase and a pair of movable selector contacts shiftable on the phase plate sequentially displaceable angularly from one of the respective fixed selector contacts to another of the fixed selector contacts for the respective phase, the movable selector contacts being connected to respective switching impedances;

at least two fixed preselector contacts for each phase on the respective phase plate and at least one movable preselector contact for each phase on the respective phase plate angularly displaceable selectively into engagement with the respective fixed preselector contacts;

a pair of fixed bypass contacts for each phase on the respective phase plate, connected to the respective switching impedances, and a pair of angularly displaceable movable bypass contacts on the respective phase plate selectively engageable with the fixed bypass contacts to open and close connection with the impedances and a load;

a respective vacuum switching cell operable to bridge the respective impedances across the respective fixed bypass contacts and mounted on the respective phase plate;

a respective triggerable force-storing actuator connected to each vacuum switching cell for operating same;

three insulating shafts extending in the housing through all of the plates and including a first insulating shaft connected to all of the movable selector contacts, a second insulating shaft connected to all of the movable preselector contacts and a third insulating shaft connected to all of the movable bypass contacts and adapted to trigger all of the force-storing actuators; and a drive for the shafts consisting of a single geneva mechanism in the housing having a single geneva wheel connected to the first insulating shaft and coaxial therewith, a drive shaft operatively connected to the geneva wheel, first coupling means effective with each angular displacement of the geneva wheel corresponding to a shift from one tap to another tap, for actuating the second insulating shaft, and second coupling means for operating the third insulating shaft from the geneva mechanism.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
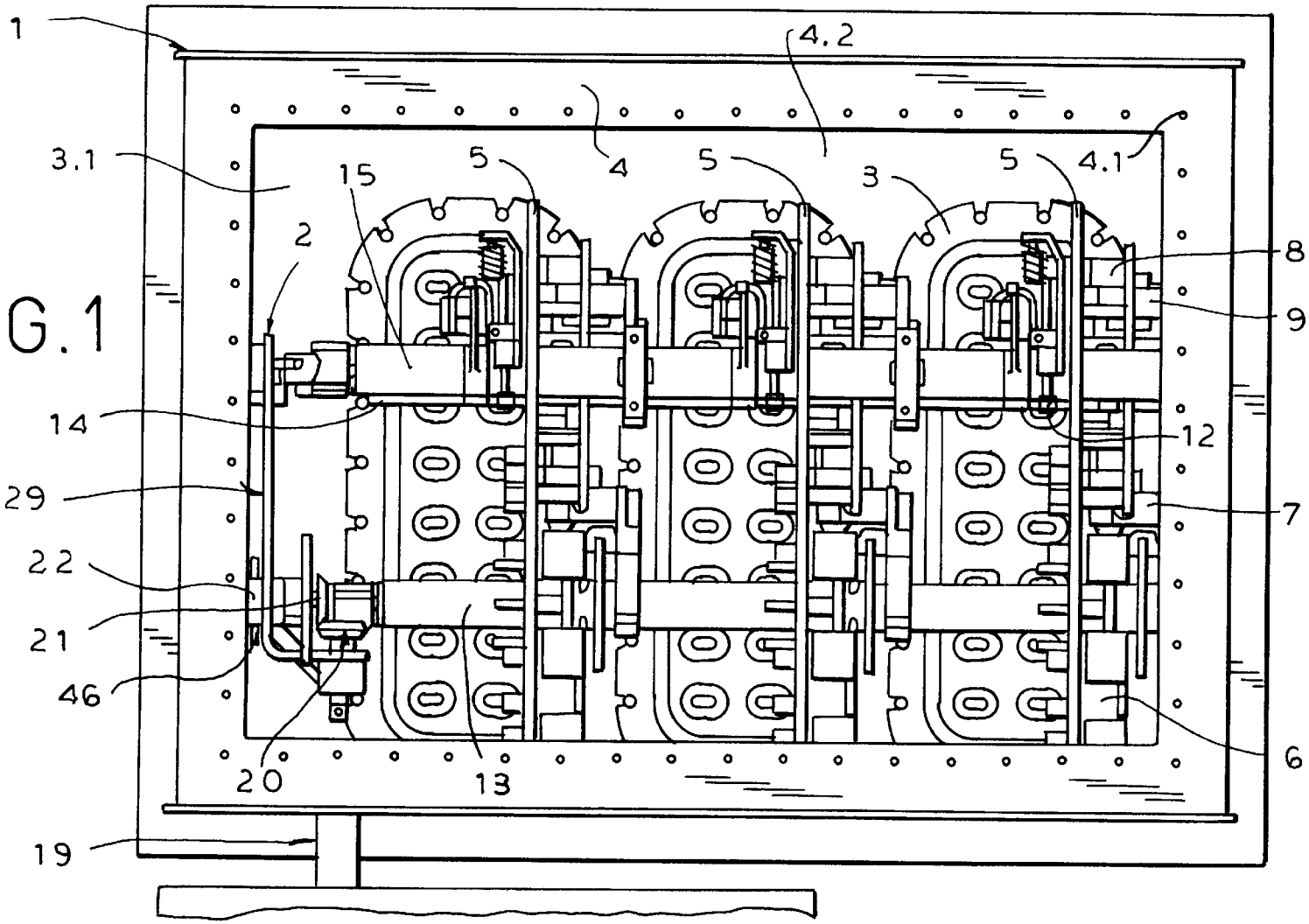
FIG. 1 is a front elevational view in diagrammatic form of a tap changer according to the invention.

The tap changer shown in FIG. 1 comprises an oil-tight housing whose front plate has been removed and which is formed with a frame 4 to which the front plate can be bolted via a screw hole 4.1. A gasket may be provided between the front plate and the frame 4 to seal the oil in the housing 1. The chamber of the housing is represented at 4.2.

At the rear side, plates 3 are provided which form oil-tight seals enabling the conductors to be led from the tap changer without leakage. The plates 3 are connected to the rear wall 3.1 of the housing 1.

On the left wall of this housing is a drive plate 2 carries a geneva mechanism for actuating the selector and preselector contacts and for a drive mechanism which will be described in greater detail hereinafter for actuating the bypass contacts and the vacuum switching cells. In parallel to the drive plate 2, the apparatus has three phase plates 5, one for each of the three phases to be switched by the tap changer. On the right hand side of each phase plate 5 (FIG. 3) are mounted the fixed selector contacts 6 arrayed in a circle about the axis 7.3 of a rotatable contact carrier 7 whose movable selector contacts are represented at 7.1 and 7.2, respectively. The selector contacts 6 are held by bolts 6.1 on the plate 5 and can be adjusted as to position by Allen screws 6.2 and 6.3, respectively.

The movable selector contacts 7.1 and 7.2 are held by screws 7.4 on the insulating contact carrier 7 and are insulated from one another. A recess 7.5 in the carrier 7 can be clamped by plate 7.6 and bolts 7.7 to a shaft serving to actuate the carrier 7.

Also on this side of the plate 5 are the fixed preselector contacts 8, also disposed along a circle, here centered on the axis 9.2 of a contact carrier 9 whose movable contacts 9.1 ride upon the slip ring segment 33 and can engage either of the fixed contacts selectively. The contact carrier 9 has a recess 9.3 in which a shaft is clamped by a plate 9.4 via bolts 9.5. The contacts 8 are held by bolts 8.1 to the plate 5 and can be adjusted by set screws 8.2.

On the plate 5 there is also provided a bypass switch which can be of the type described in our copending application Ser. No. 09/164,468 filed Oct. 1, 1998 corresponding to German application No. 197 43 865.2 filed Oct. 4, 1997. That switch comprises two fixed bypass contacts 10 attached by bolts 10.1 to the insulating plate 5 and spaced apart by a distance b along the circle of which the contact 10 correspond to circular segments. The arc lengths a of these segments is greater than the distance b and the spacing c of the movable contacts 11.1, 11.2 along this circle is greater than b but less than a. The pair of angularly displaceable movable contacts 11.1 and 11.2 are held by screws 11.3 in a contact carrier 11 which also has a recess 11.4 receiving an actuating shaft which can be clamped by a plate 11.5 and bolts 11.6 against the carrier 11. The contacts 11.1, 11.2 ride upon the circular arc segmental slip ring 34 which is also held by screws onto the plate 5 and can be connected by a terminal 11.7 to a lead conductor.

On the left side of the plate 5 (see FIG. 4) a vacuum switching cell 12 with the respective actuating mechanism can be provided.

All three phase plates can be of identical construction.

Figure 4:
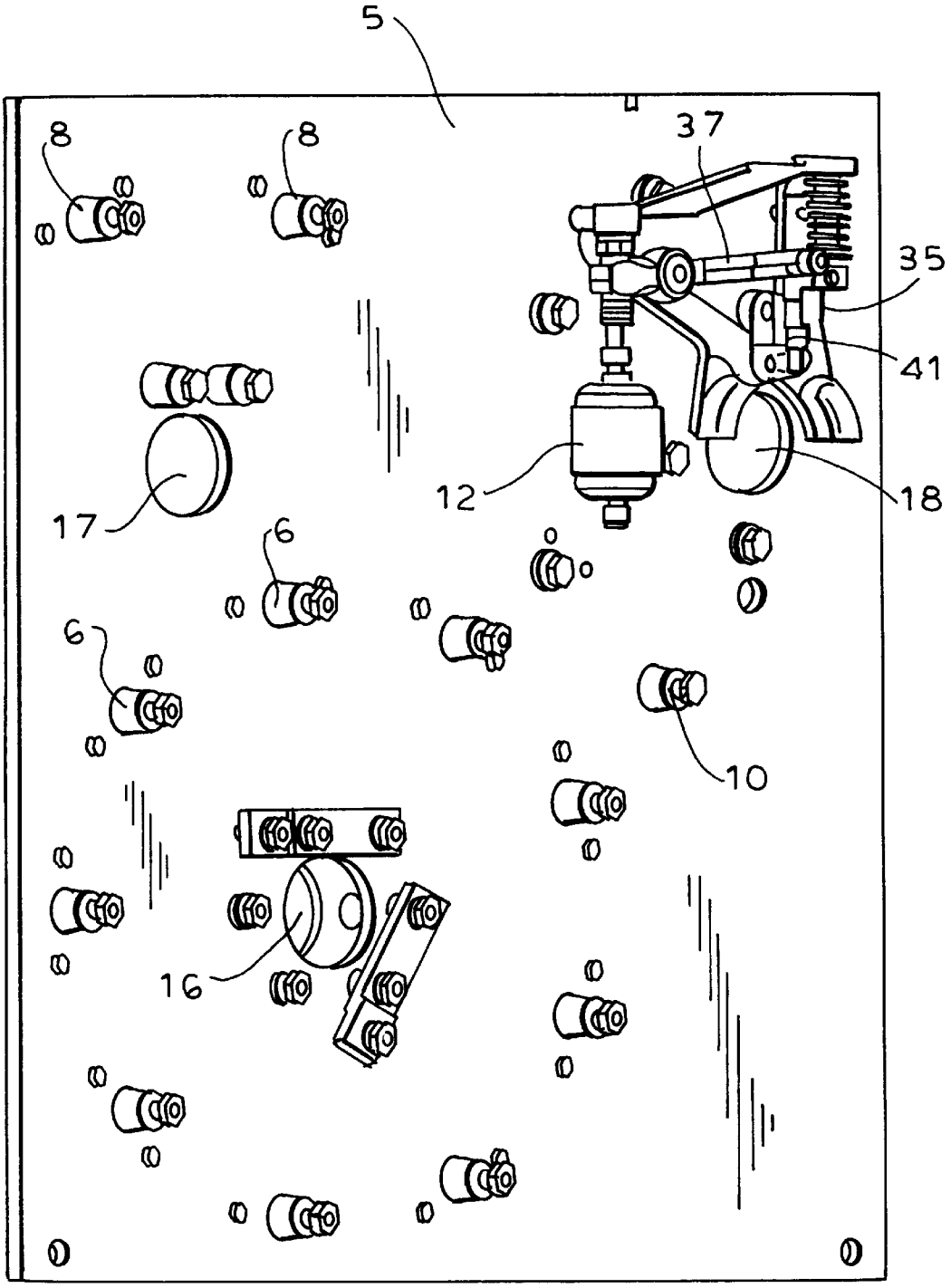
FIG. 4 is a similar view of the left side of this phase plate.

From the drive plate 3, three horizontal insulating shafts 13, 14, 15 can extend horizontally across the entire housing 1 (FIG. 1). They traverse all three phase plates and, for this purpose, pass through the bores 16, 17 and 18 therein (FIG. 4). The first insulating shaft 13 traverses the bores 16 of the phase plate 5 and is engaged with the contact carriers 7 and hence the movable selector contacts 7.1 and 7.2 of each phase.

The second insulating shaft 14, partly covered in FIG. 1, traverses the bores 17 of the phase plates 5 and is connected with the contact carriers 9 and hence the movable preselector contacts 9.1 of each phase.

The third insulating shaft 15 passes through the bores 18 of each phase plate 5 and is connected with the contact carriers 11 and hence with the movable bypass contacts 11.1 and 11.2 as well as with the corresponding vacuum switching cell 12 of each phase.

The first insulating shaft 13 thus actuates the movable selector contacts 7.1, 7.2 of each phase for engagement with the associated fixed selector contacts 6. The second insulating shaft 14 actuates the movable preselector contacts 9.1 of each phase, associated with the fixed preselector contacts 8. The third insulting shaft 15 actuates the movable bypass contacts 11.1, 11.2 of each phase and the respective vacuum switching cell 12 of each phase.

The insulating shafts 13, 14 and 15 are driven by left-hand ends by a single geneva mechanism mounted with the remaining parts of the drive system on the drive plate 2.

Figure 2:
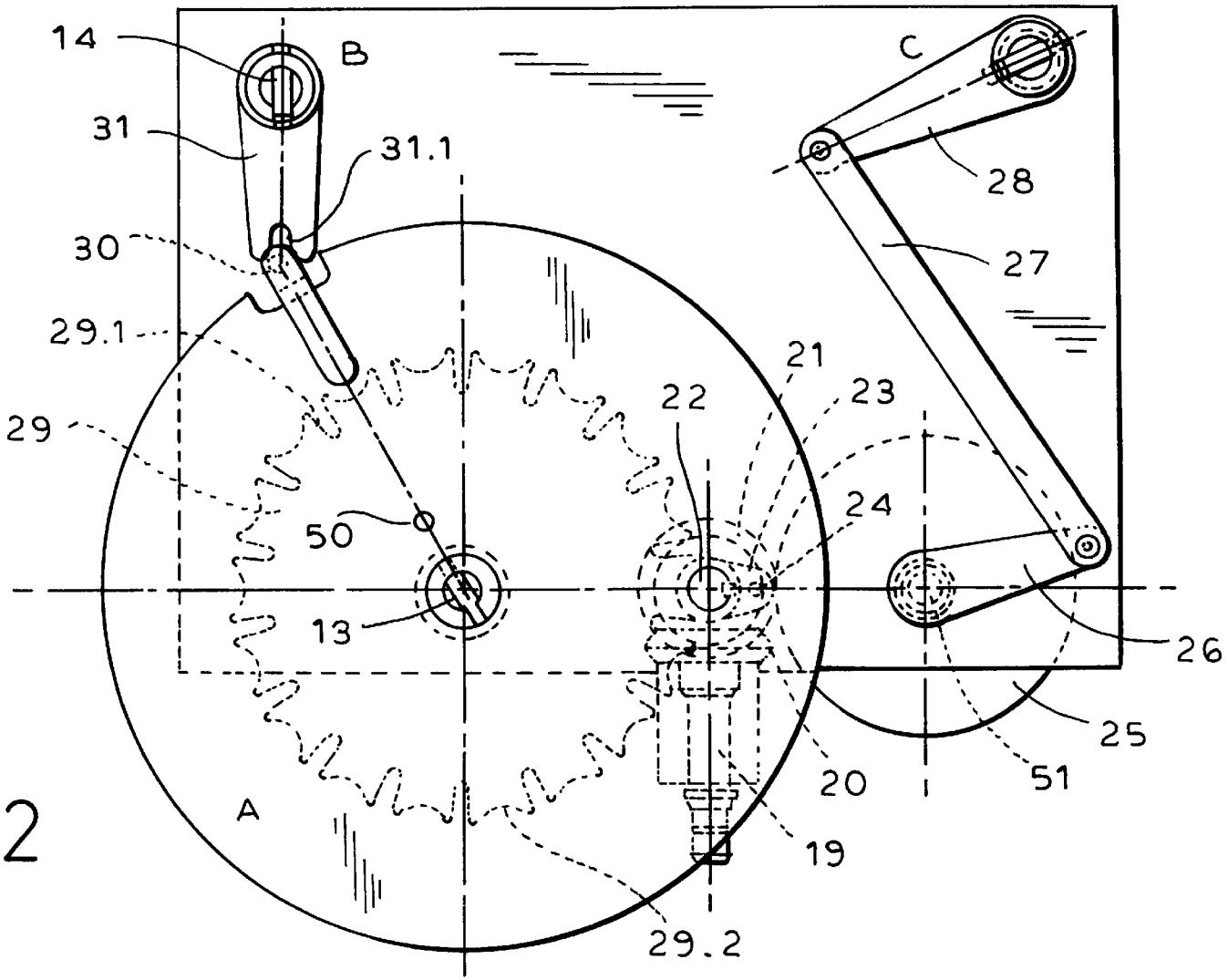
FIG. 2 is a side elevational view of the drive plate of this tap changer, drawn to a larger scale.

The drive plate shown in FIG. 32 has the three shafts 13, 14 and 15 journaled independently thereon and spaced from one another (FIG. 2). From a drive source such as an electric motor, a shaft 19 extends upwardly from below in the housing 1 and is connected by a first bevel gear 20 with a second bevel gear 21 of a shaft perpendicular to the shaft 19 and received in a journal 22. The shaft of bevel gear 21 carries a geneva mechanism driver 23 which is formed at its end with a roller 24. The bevel gear 21 is also coupled with a gear wheel 25 journaled at 51 in the drive plate 2 (FIG. 2). This third gear wheel 25 has a rocker arm 26 thereon which is articulated to a lever 27 whose free end is articulated to a further rocker lever 28 in a lever linkage secured to the shaft 15. This forms a crank-type drive.

The single geneva wheel 29 (for all three plates) is mounted on the insulating shaft 13 and has recesses 29.1 which cooperate with the roller 24 of the geneva driver 23. Geneva wheel 29 is also provided with a single actuating roller 30 in which, in a certain position of the geneva wheel 29, can engage in a slot 31.1 of a swingable lever 31 connected with the insulating shaft 14. The drive system operates as follows:

As can be seen from FIG. 2, the drive shaft 19, which can be rotated by an electric motor (not shown) with appropriate voltage, current and power control, drives via the bevel gear 10, a bevel gear 21 which entrains a driven shaft 22 carrying a geneva driver 23. The geneva driver 23 has the configuration of a lever with an entrainer pin engageable in the slots 29.1 of the geneva wheel 29. Between these slots are concave rests 29.2 which cooperate with the lever 23 to prevent stepping of the geneva wheel until the pin 24 engages in the next slot 29.1. The pin 24 has the configuration of a roller to minimize friction in its engagement with the geneva wheel. With each revolution of the shaft 22 and the lever 23, the geneva wheel 29 is stepped through a certain angle which is determined by the dimensioning of the geneva wheel and the angular spacing of the slots 29.1 therein. With each angular displacement of the geneva wheel 29, the insulating shaft 13 on which the geneva wheel is mounted, is angularly displaced through one tap selection step.

Figure 3:
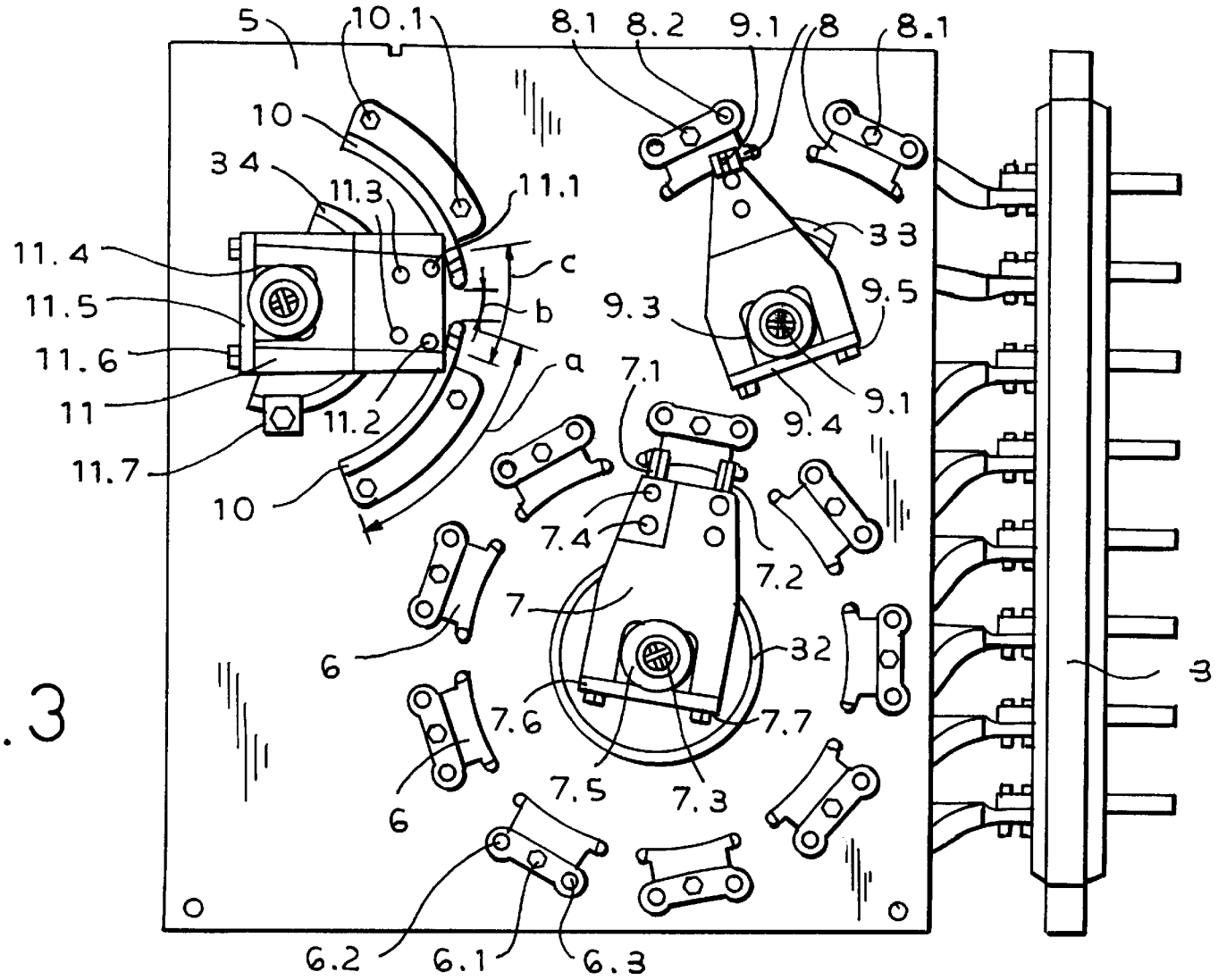
FIG. 3 is a view of the phase plate of the tap changer seen from the right side.

As can be seen from a comparison of FIGS. 2 and 3, this dimensioning is so selected that with a full revolution of the geneva wheel 19, all of the fixed selector contacts 6 will be swept by the movable selector contacts.

With each tap selection step, the movable selector contacts 7.1, 7.2 of each phase are shifted from engagement with one fixed selector contact into engagement with the next fixed selector contact to one side or the other depending upon the direction of rotation.

Simultaneously, the rotation of the bevel gear 21 is transmitted to the third gear wheel 25 (FIG. 2) and hence to a rocker lever 26. The gears are so dimensioned that for each tap selection step, the third gear 25 is rotated through 180°. The rocker 26 angularly displaces, via the link 27, a further rocker lever 28 (formerly a lever linkage) and hence the insulating shaft 15 through a certain (predetermined) angle and then returns it to its starting position. In this manner, the movable bypass contacts 11.1, 11.2 of each phase is briefly swung from one end position into its second position and then back again into that end position (see particularly FIGS. 3 and 4).

While the insulating shaft 13 for a series of tap selections is rotated through corresponding angles usually in the same direction and can complete a full revolution, the insulating shaft 15 always alternates in direction from left to right about its angular displacement and returns to its starting position. This movement can be considered an oscillation from an intermediate position into an end position and back to the bypass contacts.

A roller or pin 30 on the geneva wheel 29, which engages in a cutout of the lever 31 at a certain position of the geneva wheel, is capable of angularly displacing the lever 31 through a certain angle and hence angularly displacing the insulating shaft 14 which actuates the preselector contacts 9.1 of each phase. The actuation of the preselector is carried out only following a complete rotation of the geneva wheel 29 and after all of the steps of the tap selector have been swept by the movable contacts. In other words the geneva mechanism can allow tap selection through all of the fixed selector contacts without actuation of the preselector and the latter can then be operated, whereupon all of the selector contacts can sweep again over the fixed tap selector contacts with the preselector switch in its selection position.

Analogously, the preselector can be returned to its original position after a full revolution of the geneva wheel in the opposite direction. The preselector can here be used to set a second stage in voltage tap selection if desired.

FIG. 3 shows in greater detail the relative positioning of the fixed and movable contacts and the relative phase plates and their actuation by the insulating shafts 13, 14 and 15.

The movable selector contacts 7.1 and 7.2 which are spaced apart are so dimensioned that they can be bridged across two neighboring fixed selector contacts 6 or both rest upon only one of these contacts to accomplish the switching sequence which will be described in greater detail in connection with FIG. 7.

The movable preselector contact 9.1 simply switches over from one position to the other to switch into circuit a portion of a winding or cut out a portion of the winding depending upon whether the preselector is utilized as a coarse selector of voltage ranges or will function as a reverser as is also known in the tap selector field. It makes no difference structurally whether the preselector functions as a range selector or reversing switch.

The bypass contacts 11.1 and 11.2 also bridge the fixed contacts 10 or can be each disposed exclusively on one of the fixed contacts. It has been found to be advantageous to provide each of the movable contacts 7.1, 7.2; 9.1; 11.1, 11.2 so that they engage respective slip rings 32, 33, 34 (FIG. 3) which can be concentric with the respective shafts and hence the paths of these movable contacts. For the two movable contacts 7.1, 7.2, separate slip rings 32 can be provided which are located one above the other so that in FIG. 3 only the one is visible. Each of these slip rings can be connected to a respective one of the switching impedances mentioned earlier.

Figure 5:
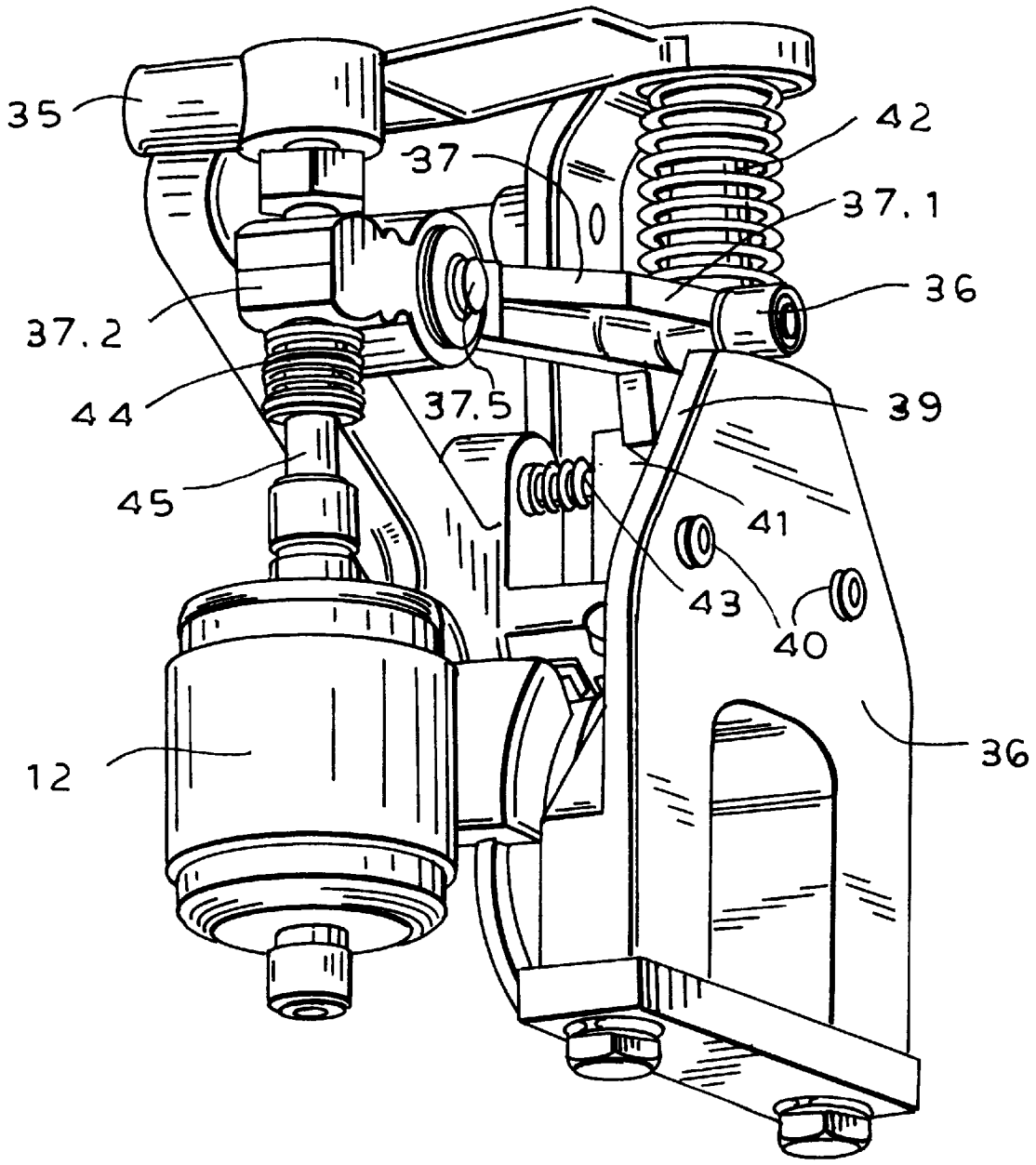
FIG. 5 is a detail of FIG. 4 showing the vacuum switching cell and its associated actuating device.

FIG. 4 shows the opposite side of each phase plate and in FIG. 5 the system for actuating the respective vacuum cells 12 can be seen in greater detail and to a larger scale.

Each phase plate 5 can thus have a bracket 35 which supports the respective vacuum switching cell 12. The actuating or triggering mechanism (triggerable force-storing actuator) is comprised of a cam 36 which is connected to the insulating shaft 15 and a double arm lever 37 which is swingable on a pivot on the bracket 35. A free end 37.1 lever 37 carries a cam follower roller 38 while the other free end 37.2 engages the vacuum switching cell 12 and specifically its actuating pin 45. The roller 38 rides along the cam curve 39 on the cam 36. On the rear side of the cam the latter has a release contour 40 formed by two individual release cams. When a pawl 41 controlled by the release contour 40 is liberated, the lever 39 is released from its position blocked by the pawl 41 when the latter is not deflected. In addition, the system comprises three springs, namely, a spring 42 braced upon the bracket 35 and pressing the follower roller 38 of lever 37 against the cam curve 39, a spring 43 pressing the pawl 41 against the lever 37 and blocking the latter in the normal position, and a third spring 44 on the actuating plunger 45 of the vacuum switching cell 12 and increasing the contact pressure required to actuate this switch in the stationary state, thereby preventing undesired actuation.

This portion of the system operates as follows:

In the stationary state, the vacuum switching cell 12 is closed. It has already been pointed out that each insulating shaft 15, with each tap change undergoes an oscillating movement from an intermediate position through a predetermined angle to the right or left, depending upon the direction of rotation of the drive shaft 19, and then again returns to this intermediate position.

Upon such angular displacement of the insulating shaft 15, the latter entrains the cam 36 correspondingly. The lever 37 has its cam follower roller 38 biased by the spring 42 to follow the cam curve 39. This is, however, not possible as long as the pawl 41 remains in place to arrest the lever 37. Only when the angular displacement reaches a certain point will the release contour 40 liberate the pawl 41 and allow it to be displaced against the force of the spring 43. The lever 37 is then freed to drive with the force of the spring 42 the vacuum switch cell 12 into its open circuit position. This jump-like action occurs the instant that the lever 37 is freed by the pawl 41.

The roller 38 then comes to lie again on the cam curve 39 and with rotation of the cam 36 in the opposite sense by the insulating lever 15, the cam 36 gradually closes the vacuum switch cell 12 and at a certain point, the pawl 41 will spring into engagement with the lever 37 to block the latter and restore the starting position for the next tap change operation with a rotation of the insulating shaft 15 in the other direction, there is an analogous actuation of the vacuum switch cell. The mechanism ensures rapid opening of the vacuum switching cell and a continuous cam-dependent closing thereof. In the stationary state the cam 39 also holds the lever 37 fixed against displacement so that it cannot even vibrate.

Figure 6:
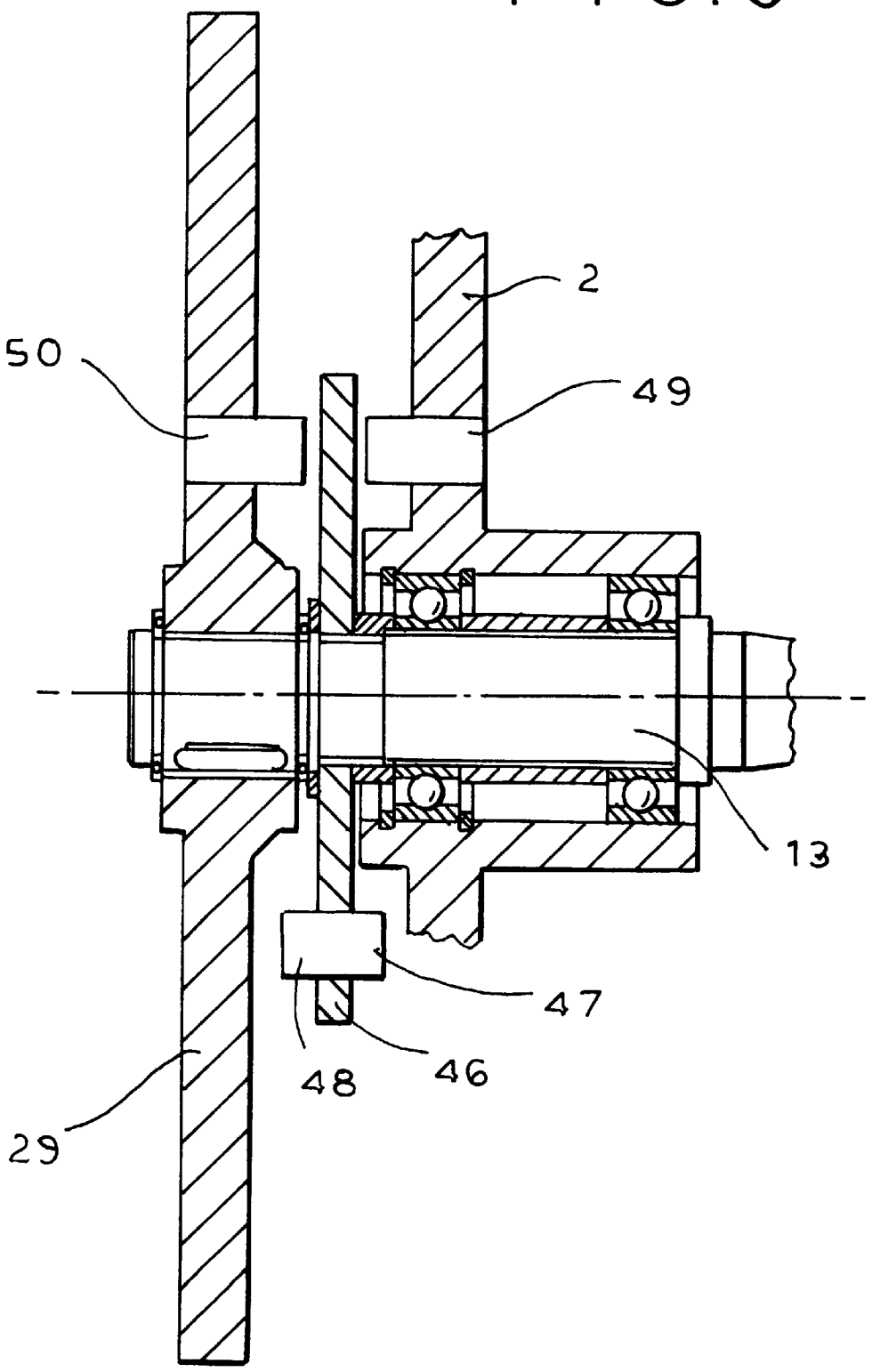
FIG. 6 is a detail of FIG. 2 showing the limiting position from the side; and FIGS. *7a–7f* are circuit diagrams illustrating the succession of operations of a tap changer having selector contacts, a vacuum switching cell and bypass contacts in accordance with the invention.

FIG. 6 shows the geneva mechanism in greater detail in terms of its limiting mechanism. It has already been indicated that the geneva wheel 29 should make a maximum of two revolutions in either direction and for this purpose a limiting or blocking device must be provided to prevent the further rotation in either direction. The term "revolution" is here meant to mean a full revolution of 360° less the angular displacement corresponding to two tap selection steps. This is achieved with the aid of a blocking disk 46 which is freely rotatable on the insulating shaft 13 and can be located between the drive plate 2 and the geneva wheel 29. The blocking disk 46 has a respective entrainer 47, 48 projecting from each side and preferably formed by a common pin traversing the plate 46. The entrainers 47 and 48 correspond to a fixed abutment 49 on the drive plate 2 and to a is further entrainer 50 on the geneva wheel 29.

As has been noted, geneva wheel 29 can be rotated in either direction through a full revolution. At the end of this full revolution, the entrainer 50 engages the entrainer 48 so that with further revolution in the same sense, ultimately the pin 47 will engage the abutment 49 and block further rotation not only of the disk 46 but of the geneva wheel 29. That limits the geneva wheel to two revolutions in either sense. Upon rotation in the opposite direction, the floating blocking disk 46 will again come into play only after a full revolution of the geneva wheel. If two entrainers 50 are provided along the same circular segment on the geneva wheel 29, the angular displacement of the latter can be limited further. If only a single entrainer 50 is provided, it can be shaped or dimensioned optionally. This ensures in a simple manner the limiting of the geneva mechanism to any desired angular displacement which can be less than a full rotation of 360° or any particular displacement in terms of the angular displacement required for the tap selection operation.

Referring now to FIGS. 7*a*–7*f* it can be seen that utilizing the system previously described, tap selection can be effected between two successive transformer taps n and n+1, corresponding to the fixed contacts 6 previously described. Here the movable contacts of the tap selector, corresponding to the contacts 7.1 and 7.2, are represented at P1 and P2 and are connected respectively to one end of a switching impedance R1, R2 shown as a coil.

Figure 7C:
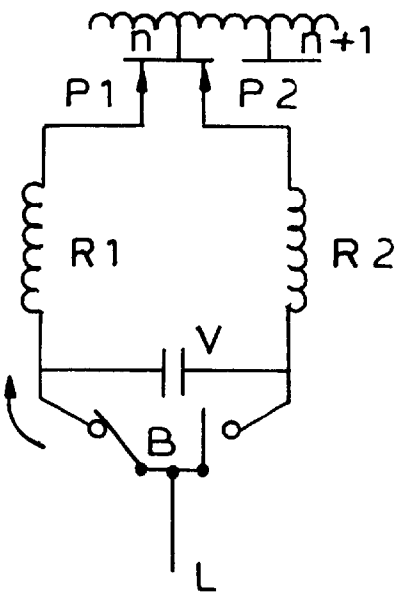
Figure 7B:
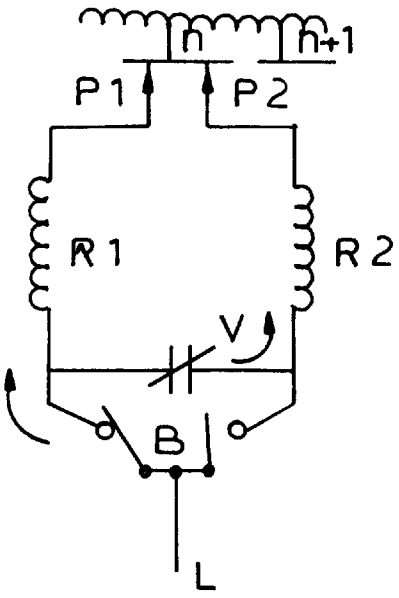
Figure 7A:
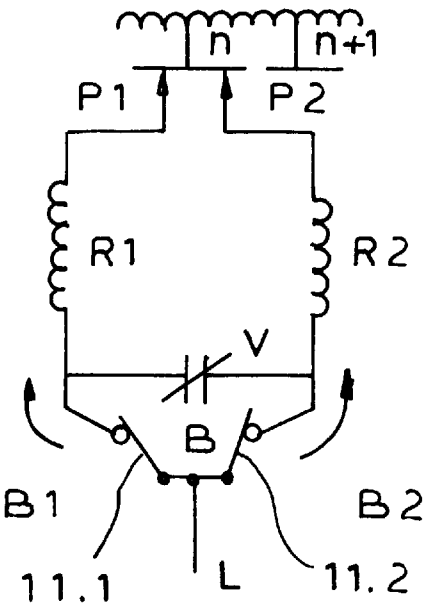

The opposite ends of each pair of coils are bridged by the vacuum switching cell V which can correspond to the cells 12 previously described and by a bias switch B whose fixed bias contacts are represented at B1 and B2 in FIG. 7*a*. The movable contacts 11.1 and 11.2 are connected to the load represented at L for the particular phase. Prior to a tap selection operation, the vacuum switching cell V is closed (FIG. 7*a*) so that separate currents flow through the switching impedances R1 and R2 and the bias switch contact 11.1 can be opened (FIG. 7*b*). The vacuum switching cell V can then open (FIG. 7*c*) so that the current flow takes place through the impedance R1 and the tap selector can be shifted to the next tap n+1 as has been shown in FIG. 7*d*.

Figure 7F:
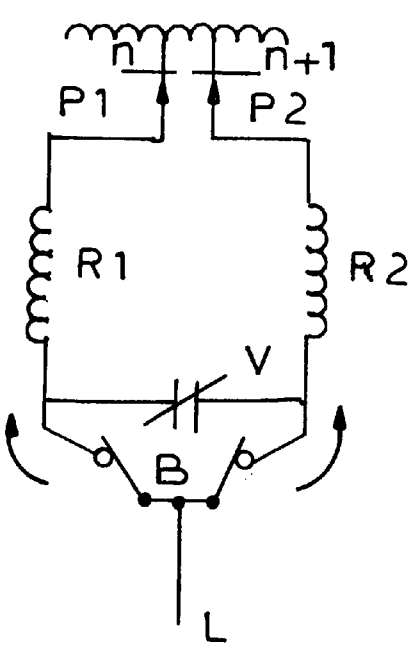
Figure 7E:
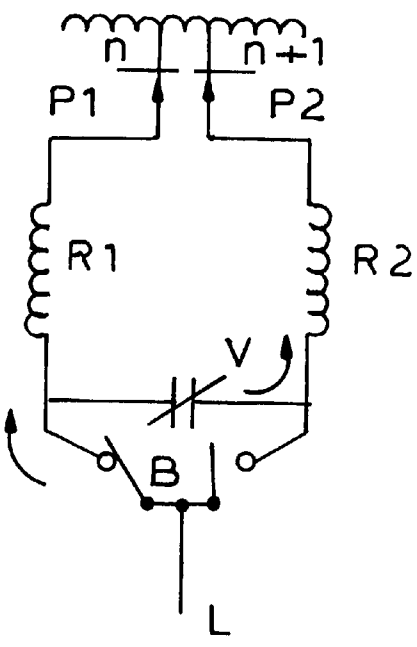
Figure 7D:
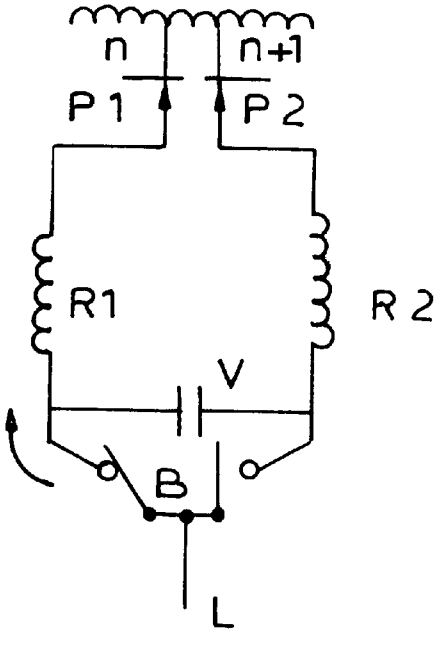

The vacuum switching cell V is then closed (FIG. 7*e*) to allow current to flow through both impedances, whereupon the contact 11.2 is closed, FIG. 7*f*. This, of course, represents half the cycle. When the switch contact 11.1 is then opened and the vacuum switching cell V is open, the tap selector can be shifted further until both movable contacts come to lie upon the contact of tap n+1, whereupon the vacuum selector switch V can then be closed and the bias contact closed to restore the situation in FIG. 7*a* but with selection of the tap n+1. It is this sequence of operations that is carried out with each tap selection in the mechanism of FIGS. 1–6.

We claim:

1. A multiphase reactor-switching tap selector for interruption-free tap shifting under load, said tap selector comprising:

a housing;

a respective phase plate for each phase of the tap selector disposed in said housing, said phase plates being mutually parallel and spaced apart in said housing;

respective fixed selector contacts on said phase plate connected to respective transformer taps of the respective phase and a pair of movable selector contacts shiftable on said phase plate sequentially displaceable angularly from one of the respective fixed selector contacts to another of said fixed selector contacts for the respective phase, said movable selector contacts being connected to respective switching impedances;

at least two fixed preselector contacts for each phase on the respective phase plate and at least one movable preselector contact for each phase on the respective phase plate angularly displaceable selectively into engagement with the respective fixed preselector contacts;

a pair of fixed bypass contacts for each phase on the respective phase plate, connected to the respective switching impedances, and a pair of angularly displaceable movable bypass contacts on the respective phase plate selectively engageable with the fixed bypass contacts to open and close connection with said impedances and a load;

a respective vacuum switching cell operable to bridge the respective impedances across the respective fixed bypass contacts and mounted on the respective phase plate;

a respective triggerable force-storing actuator connected to each vacuum switching cell for operating same;

three insulating shafts extending in said housing through all of said plates and including a first insulating shaft connected to all of said movable selector contacts, a second insulating shaft connected to all of said movable preselector contacts and a third insulating shaft connected to all of said movable bypass contacts and adapted to trigger all of said force-storing actuators; and a drive for said shafts consisting of a single geneva mechanism in said housing having a single geneva wheel connected to said first insulating shaft and coaxial therewith, a drive shaft operatively connected to said single geneva wheel, first coupling means effective with each angular displacement of said single geneva wheel corresponding to a shift from one tap to another tap, for actuating said second insulating shaft, and second coupling means for operating said third insulating shaft from said single geneva mechanism, said first coupling means comprising:

a roller connected to said single geneva wheel; and a lever having a slot engageable by said roller in a certain position of said geneva wheel, said lever being connected to said second insulating shaft, said second coupling means including a gear wheel operatively connected to said drive and a lever linkage connecting said gear wheel with said third insulating shaft for oscillating said third insulating shaft about a predetermined angle depending upon the direction of rotation of said gear wheel and back to a starting position.

2. The tap selector defined in claim 1 wherein said fixed and movable bypass contacts are located on one side of each phase plate and the vacuum switching cell of the respective phase is mounted on the opposite side of the respective phase plate.

3. The tap selector defined in claim 1 wherein said pair of movable selector contacts of each phase plate are electrically insulated from one another and are carried by a common contact carrier for joint rotation of each of said movable bypass contacts are electrically connected together on a further contact carrier for joint rotation thereby.

4. The tap selector defined in claim 1 wherein each of said force-storing actuators comprises a spring biased double arm lever acting upon the respective vacuum switching cell and having a cam follower roller engaging a cam connected to the respective third insulating shaft, a pawl arresting said lever, and means on said cam for releasing said pawl for sudden displacement of said lever to actuate the vacuum switching cell.

5. The tap selector defined in claim 4 wherein said lever is swingable on a bracket secured to the respective phase plate, a first spring acts upon said lever to bias some against said vacuum switching cell, a second spring presses said cam follower roller against said cam and a third spring urges said pawl into engagement with said lever.

6. The tap selector defined in claim 5 wherein said cam has a release contour formed with a pair of camming members for releasing said pawl from said lever.

7. The tap selector defined in claim 1, further comprising a blocking disk freely rotatable on said first shaft and provided with means for limiting angular displacement of said single geneva wheel.

8. The tap selector defined in claim 7 wherein said means for limiting displacement of said geneva wheel includes a pin extending through said blocking disk and forming an abutment engageable with a stop on one side thereof and an abutment engageable with an entrainer on said geneva wheel on an opposite side of said blocking disk.

* * * * *